United States Patent [19]

Forrest

[11] Patent Number: 4,464,707

[45] Date of Patent: Aug. 7, 1984

[54] LIGHTING FIXTURE

[76] Inventor: Louis Forrest, 197 North Ave., Westport, Conn. 06880

[21] Appl. No.: 359,048

[22] Filed: Mar. 17, 1982

[51] Int. Cl.[3] ..... F21S 3/00

[52] U.S. Cl. ..... 362/222; 362/221; 362/223; 362/270; 362/285; 362/296; 362/297; 362/307; 362/310; 362/346; 362/368; 362/370; 362/371; 362/375; 362/427; 362/432

[58] Field of Search ..... 362/222, 221, 223, 270, 362/285, 296, 297, 307, 310, 346, 368, 370, 371, 375, 427, 432

[56] References Cited

U.S. PATENT DOCUMENTS

| | | | |
|---|---|---|---|
| 4,074,122 | 2/1978 | Moore | 362/223 |
| 4,261,028 | 4/1981 | Adam | 362/224 |
| 4,262,326 | 4/1981 | Lewin | 362/223 |
| 4,290,096 | 9/1981 | Szpur | 362/223 |
| 4,323,953 | 4/1982 | Hutchison | 362/223 |

*Primary Examiner*—Stephen J. Lechert, Jr.

*Attorney, Agent, or Firm*—Epstein & Edell

[57] ABSTRACT

A lighting fixture emits a beam covering in excess of 180° by employing a reflector of parabolic cross-section and placing a linear light source perpendicular to the parabolic axis at or slightly forward of the parabola ends. A mounting plate containing the lamp socket and lamp ballast is connected to the reflector by means of a single screw to facilitate installation and maintenance. End members for the reflector include projecting collars which rotatably receive annular flanges from junction boxes through which power supply leads pass to connect to the lamp socket and pass through a raceway located behind the reflector to other fixtures mounted in tandem. The collar and flange can be secured together in any rotational position within a range of 360°. A swivel form of junction box includes two members which are mutually rotatable about an axis perpendicular to the collar/flange axis to increase the positional adjustability of the fixture.

20 Claims, 23 Drawing Figures

10
11
13
15
17
19
21
23
25
27
29
30
31
33
35
37
39
40
41
43
45
47
49
50
51
53
55
57
59
61
63
65
A
B
7

LIGHTING FIXTURE

TECHNICAL FIELD

The present invention relates to lighting fixtures in which an elongated or linear light source is mounted to maximize the illuminated area and facilitate re-direction of the emitted light beam.

BACKGROUND OF THE INVENTION

It is desirable, particularly for outdoor lighting, to maximize the area illuminated by a single light source so as to minimize the number of sources required to illuminate a prescribed area. Particularly for outdoor security lighting use, it is also desirable to utilize high intensity discharge lamps (such as low and high pressure sodium lamps) or fluorescent lamps, both of which are linear or elongated light sources. These light sources are desirable because of their relatively high intensity light output. One way to achieve maximum area coverage, of course, would be to support such a source vertically, concentrically surrounded by a light-transmitting shield, to thereby obtain coverage of 360°. Such an arrangement, however, eliminates any possible use of a reflector to intensify the emitted light. Thus, although a 360° beam is provided, the useful intensity from that beam falls off beyond a relatively short distance from the source. Therefore, light fixtures employing reflectors have been used almost exclusively for outdoor security lighting so as to increase the "throw" of the emitted beam. An example of such a fixture is found in U.S. Pat. No. 2,964,616 to Seidman. In that patent, the disclosed reflector is semi-cylindrical in shape and serves to intensify the emitted beam and significantly increase its "throw". However, the beam angle is relatively narrow (i.e. considerably less than 180°) so that it is often necessary to use plural lamps to achieve full area coverage. It is also desirable, in the case of outdoor security lighting, to provide a fixture which can be easily re-directed in any dimension to change the beam direction. For example, the afore-mentioned Seidman patent discloses a mounting arrangement for a lamp fixture wherein the fixture can be rotated to any position in a full 360° range about an axis parallel to the elongation dimension of the lamp. However, this flexibility is provided in only one dimension.

Other desirable features for outdoor lighting fixtures are ease in mounting, ease in electrical interconnection and ease in maintenance.

SUMMARY OF THE INVENTION

It is an object of the present invention to provide a lighting fixture for a reflected linear light source which permits coverage of at least 180° without significantly sacrificing the distance covered by the emitted beam.

It is another object of the present invention to provide a lighting fixture which can be easily and securely repositioned over a wide range of positions in at least two dimensions.

It is still another object of the present invention to provide a lighting fixture which emits a beam of light over an angle of at least 180°, is positionally adjustable in at least two dimensions over a wide range of positions, and which is simply and easily installed, connected and maintained.

It is yet another object of the present invention to provide a lighting fixture which can be easily mounted together with one or more light fixtures with a minimum of parts to achieve a desired illumination coverage.

In accordance with the present invention, a lighting fixture includes an elongated anodized aluminum reflector of parabolic transverse cross-section. A linear light source is mounted perpendicular to the axis of the parabola with at least a portion of the source extending radially beyond the ends of the reflector. The beam emitted by the fixture is intensified by the reflector and covers an angle in excess of 180°, depending upon how much of the linear light source extends beyond the reflector ends.

The light source is preferably engaged in a socket which in turn is secured to a mounting plate along with the source ballast. The plate is secured to the reflector by a single screw so that the entire mounting plate, including the source, socket and ballast, can be easily replaced.

A raceway for electrical connection leads is defined behind the reflector and runs lengthwise of the reflectors so as to permit the leads to be guided through to other fixtures mounted in tandem. Collars defined in the end members for the frames engage annular flanges of junction boxes in any position within a 360° range. The fixture may, therefore, be rotated about the fixedly mounted junction box to adjust or re-direct the beam while the power supply leads are passed through the flange and collar to the socket and raceway. A swivel junction box is also disclosed wherein two members of the box are mutual rotatable about an axis perpendicular to the collar/flange axis to provide another dimensional adjustment of the beam.

BRIEF DESCRIPTION OF THE DRAWINGS

The above and still further objects, features and advantages of the present invention will become apparent upon consideration of the following details of the description of the specific embodiments thereof, especially when taken in conjunction with the accompanying drawings wherein.

DESCRIPTION OF THE PREFERRED EMBODIMENTS

Figures 1, 6, 7, 8:
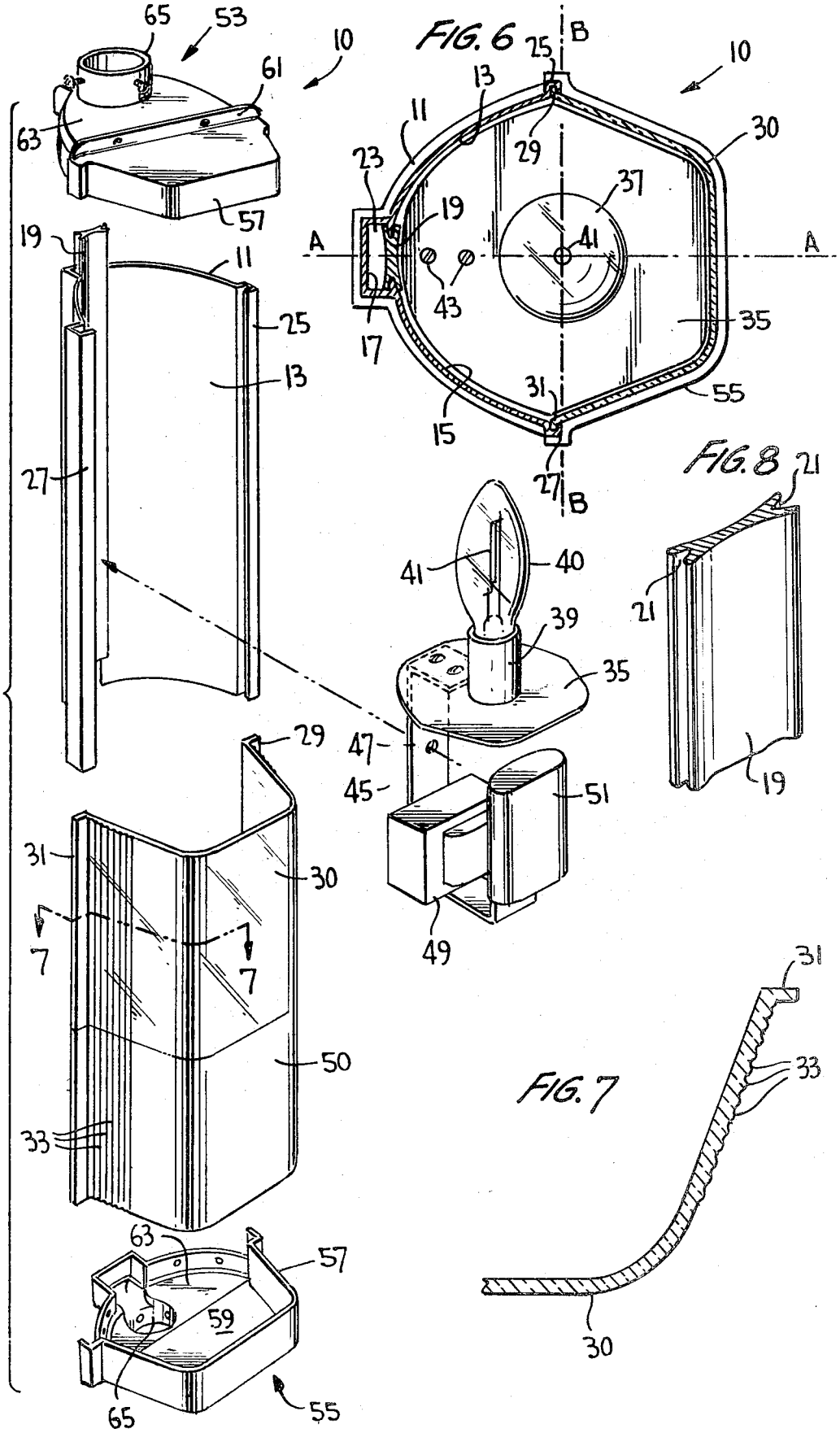
FIG. 1 is an exploded view in perspective of a lighting fixture in accordance with one embodiment of the present invention.
FIG. 6 is a view in section taken along lines 6—6 of FIG. 2.
FIG. 7 is a view in section taken along lines 7—7 of FIG. 1.
FIG. 8 is a detailed view in perspective of a portion of a connecting strip employed in the light fixture embodiment of FIG. 1.
Figure 2:
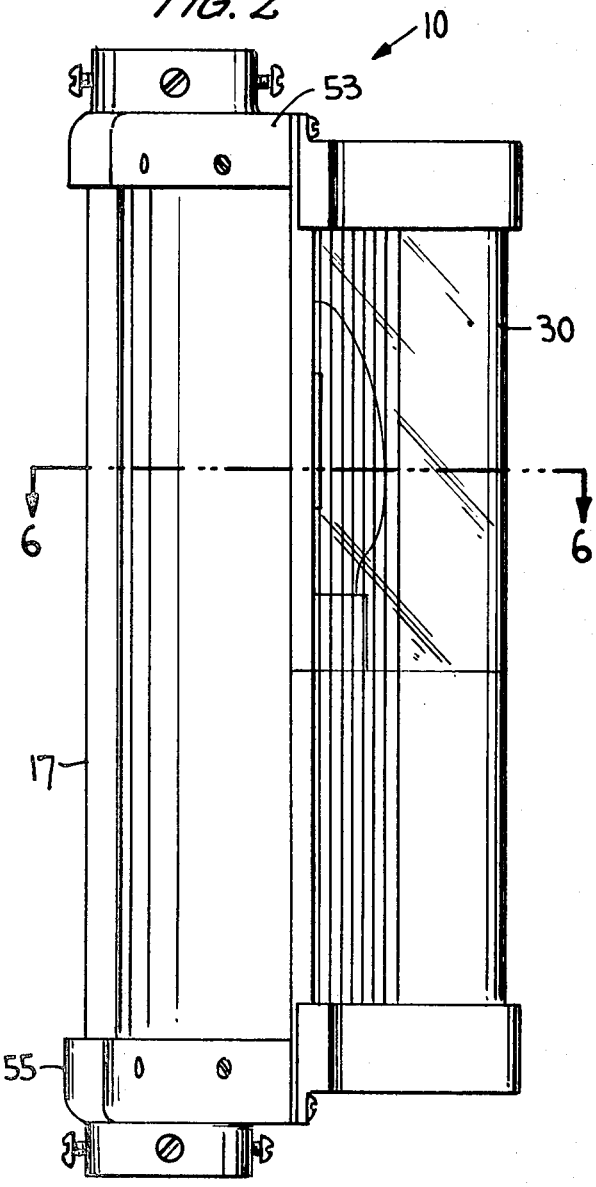
FIG. 2 is a side view in elevation of the lighting fixture of FIG. 1.

Referring specifically to FIGS. 1 through 8 of the accompanying drawings, a lighting fixture, constructed in accordance with the principles of the present invention, is generally designated by the reference numeral 10. The fixture includes an elongated frame member 11 having two reflective surfaces 13 and 15 which, in transverse cross-section (as best illustrated in FIG. 6), form respective symmetrical portions of a parabola. Reflective surfaces 13 and 15 are separated from one another to provide a gap extending longitudinally of reflector 11 and disposed symmetrically with respect to the axis of symmetry A—A of the parabolic reflector. Reflector 11 is recessed in the region of the gap between the two reflective surfaces 13, 15 so as to define a channel portion 17. A connecting strip 19 is provided with guide channels 21 extending longitudinally along its edges to receive respective portions of reflecting surfaces 13, 15 which project over the channel 17. In this manner, connecting strip 19 slidably engages the connecting surfaces to form a continuation of the parabolic reflecting surfaces. With connecting strip 19 spaced from the rear portion of channel 17, a hollow raceway is defined thereby and extends longitudinally of the reflector, behind connecting strip 19, and serves to conduct electrical wiring through the light fixture. The forward ends 25, 27 of reflecting portions 13 and 15, respectively, define an imaginary plane B—B which perpendicularly intersects the axis of symmetry A—A for the reflector. Reflector ends 25, 27 are provided with recessed channels so as to slidably receive flanged portions 29, 31, respectively, of a light-transmitting fixture cover 30. Cover 30 projects forwardly of the imaginary plane B—B as necessary to accommodate the positioning of a light source, described below, which is positioned within the fixture. In the particular embodiments described herein, the transverse section of the elongated cover 30 is of generally trapezoidal shape. This particular configuration is not crucial, however, for purposes of the present invention. Cover 30 is provided with a plurality of longitudinally extending ridges 33 which are spaced in parallel relation from one another proximate the two flanged ends 31, 29 of the cover. The ridges 33 serve to refract light emanating from the light source in the manner described below.

A lamp and lamp socket mounting arrangement includes a mounting plate 35 having a peripheral contour which generally matches the combined contour of reflecting surfaces 13, 15, connecting strip 19 and the interior of cover member 30. Socket mounting plate 35 is provided with a relatively large through hole which is centered at the intersection of imaginary plane B—B and the axis of symmetry A—A of the parabolic reflector. A lamp socket 39 is mounted, by means of screws or the like, on plate 35 in a centered position relative to through hole 37. Lamp socket 39 receives a light source 40 in threaded engagement therewith. The particular light source 40 illustrated in the embodiment of FIGS. 1–8 is a high-intensity discharge lamp of the type wherein an elongated filament or other elongated light source 41 is positioned coaxially with respect to socket 39 and, therefore, resides within imaginary plane B—B so as to intersect the axis of symmetry A—A of the reflector in a perpendicular manner. Importantly, by means of such intersection, a portion of the source 41 is positioned forwardly of imaginary plane B—B so as to extend beyond the ends 25, 27 of the parabolic reflector. The actual mounting arrangement, in accordance with the principles of the present invention, requires that at least a portion of light source 41 be forwardly disposed with respect to ends 25, 27 of the parabolic reflector. However, this can also be achieved by placing the entire filament or light source 41 forwardly of imaginary plane B—B.

Mounting plate 35 is also provided with a pair of mounting holes to which an angle bracket 45 can be secured by means of screws and nuts, or the like. Angle bracket 45 includes a top portion which is secured to plate 35, a second portion which extends perpendicular to the top portion and which is provided with a single screw hole 47, a third portion which extends perpendicular to the second portion and parallel to the first portion and on which a lighting transformer 49 is mounted, and a final portion extending upward in a perpendicular fashion from the bottom portion and on which a lighting ballast member 51 is mounted. Mounting of the transformer 49 and ballast member 51 to the angle bracket 45 may be achieved by screws and nuts or other similar attachment means. Importantly, the lamp 40, socket 39, plate 35, angle bracket 45, transformer 49 and ballast member 51 are part of a complete assembly which can be installed and/or removed from the fixture as a unit. The unit is affixed to the fixture by means of a single screw extending through the screw hole 47 and engaging the connecting strip 19. Therefore, by removing the single screw extending through hole 47, the entire light source unit can be removed for maintenance and replaced by securing the single screw once again.

Frame member 11 is preferably made of aluminum, and the reflective surfaces 13, 15 are anodized so as to enhance the reflectivity characteristics and minimize irregularities in the reflective surface. In addition, the lower portion 50 of light cover 30 has its interior surface covered with a light-blocking paint. This portion 50 of the light cover covers the portion of the fixture interior below mounting plate 35 and, therefore, hides the ballast, transformer and mounting bracket from view. The light transmissive portion of cover 30 exposes only the portion of the reflector and light source above the mounting plate 35.

Fixture 10 is provided with a pair of substantially identical end plates 53, 55. Each end plate includes a generally trapezoidal portion configured to match the transverse edge of reflector 30 and is provided with a peripheral lip 57 which extends longitudinally over a portion of the cover 30. The trapezoidal surface of each of the end members is provided with a rubber gasket which is placed flush against the corresponding trapezoidal edge of cover 30 to provide a weather-proof seal. The trapezoidal section of the end members is provided with a flange 61 through which that section is secured, by means of screws and nuts, or the like, to a generally parabolic section 63 which is configured to match the corresponding edge of parabolic reflector 11. An annular collar 65 extends outwardly from parabolic section 63 and is provided with a plurality of angularly-spaced, radially-extending through holes for mounting purposes as described below. The hollow collar 65 provides access for wiring for the fixture. Importantly, the collar is situated to permit wiring brought into the fixture to be conducted directly to the components associated with mounting plate 35 or into the raceway 23. In this manner, wiring can be extended to multiple units mounted in tandem by simply extending the wiring through the raceway 23 and out through the opposite end member for the fixture.

Figure 17:
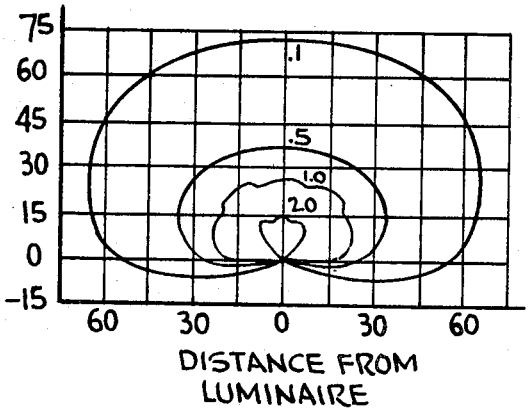
FIG. 17 is a graph showing the light intensity as a function of distance for a typical lighting fixture constructed in accordance with the present invention.

The importance of the placement of the filament or other longitudinal light source 41 relative to the forwardmost ends 25, 27 of the parabolic reflector relates to the angle of coverage provided by the light fixture. Specifically, with reference to FIGS. 6 and 17, by placing a portion of the linear or elongated light source 41 forwardly of the ends 25, 27, a coverage angle of at least 180° is assured. In other words, the parabolic reflector provides necessary coverage for an angle just slightly less than 180°; the exposure of a portion of the light source beyond the ends of the reflector permit light to be emanated through cover 30 along the imaginary plane B—B to fill in the 180° coverage angle. The graph in FIG. 17 is an isofootcandle diagram which shows the light intensity, in foot candles, in an illuminated area which is illuminated by a lighting fixture of the type described above in relation to FIGS. 1–8. The various grid lines in the graph represent distances along two axes from the 0,0 point representing the intersection of axis of symmetry A—A with plane B—B in FIG. 6. More specifically, the point 0,0 represents the horizontal position of light source 41 which is assumed to extend vertically and parallel to the reflector 11. The angle of coverage is seen to exceed 180°, the amount of excess being determined by the portion of light source 41 which resides forwardly of the plane B—B.

Figure 9:
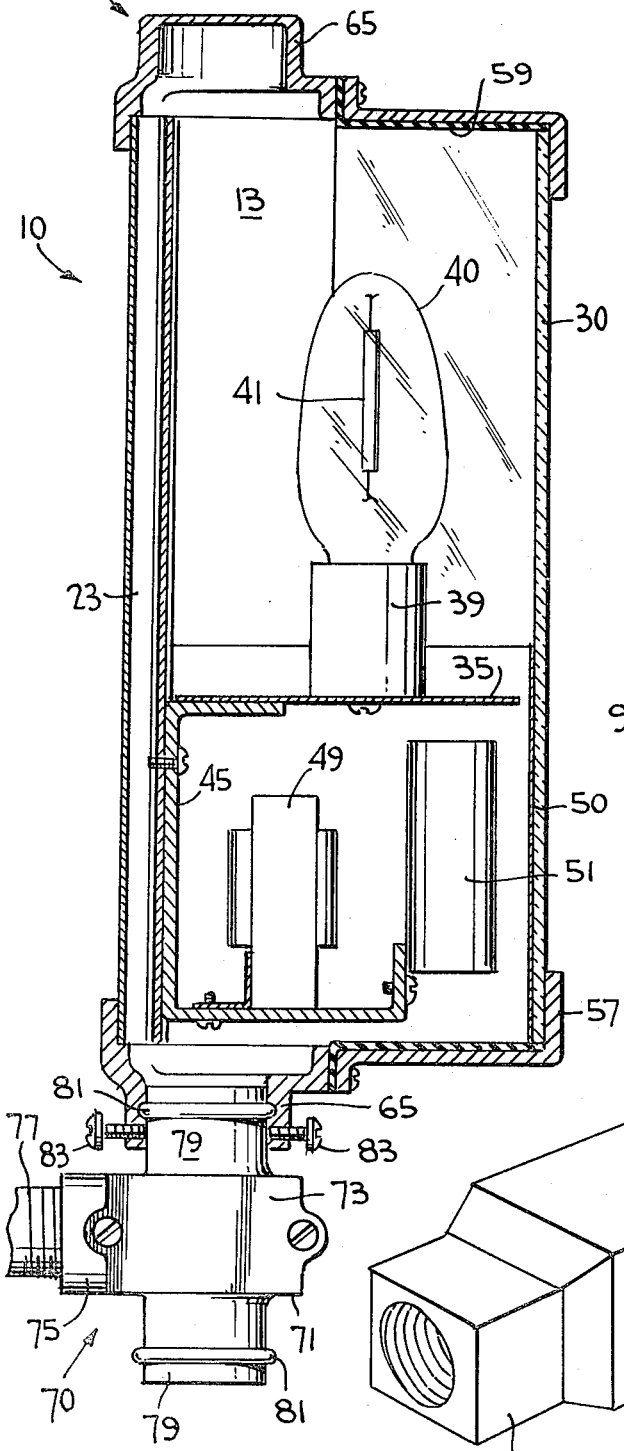
FIG. 9 is a view in section taken along lines 9—9 of FIG. 3 and further illustrating, in plan, a junction box for use in mounting the lighting fixture.
Figure 10:
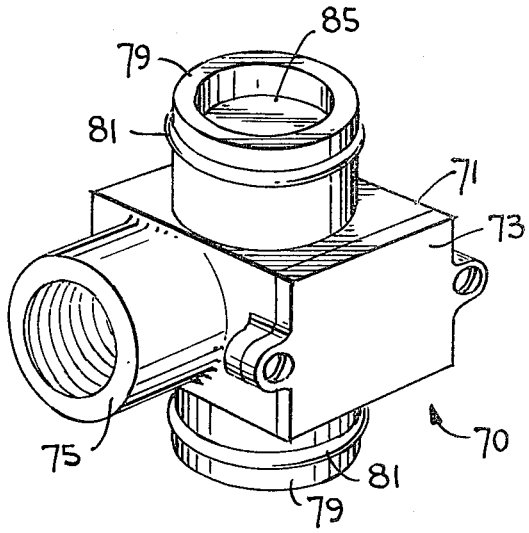
FIG. 10 is a view in perspective of the junction box illustrated in FIG. 10.

One possible means for mounting the fixture of FIG. 1 is illustrated in FIGS. 9 and 10. Specifically, a junction box 70 comprises a housing 71 of generally hollow, cubicle configuration which includes an access opening covered by a removable cover 73. Specifically, cover 73 is removably secured to the housing over an access opening by means of screws or the like. A suitable gasket may be disposed between the cover 43 and housing to effect a weather-proof seal when the screws are tightened. An internally-threaded collar 75 extends from one side of housing 71 and is adapted to receive a tubular support rod 77 in threaded engagement. The support rod 77, in turn, is secured to a rigid support structure in a manner described below. Importantly, tubular support rod 77 is hollow and conducts wiring therethrough into the junction box for connection to the lighting fixture. Thus, the tubular support rod 77 serves both a support function and a cable conduit function.

A pair of oppositely-extending tubular flange members 79 extend from opposite sides of housing 71. Resilient O-rings are positioned in grooves formed on the flange members 79 and are adapted to provide a weather-proof seal between the flange members and the collar 65 projecting from the end member of a lighting fixture 10. Specifically, each annular flange member 79 is adapted to fit slidably and concentrically within annular collar 65, as best illustrated in FIG. 9, so that the O-ring extends beyond the mounting holes defined in the collar 65. The flange 79 and collar 65 are mutually rotatable to any position within a 360° range so that the fixture 10 may be angularly positioned within a 360° range as desired. Screws 83 are tightened in the threaded mounting holes to engage annular flange 79 to the collar 65 in the desired rotational position. Any time it is desired to change the angular position of fixture 10, screws 83 are loosened and the fixture is rotated relative to the junction box 70 to the new desired position; the screws 83 are then tightened to secure the fixture properly. The wires conducted through support rod 77 are passed through the junction box 70, flange 79 and collar 81 into the fixture 10. If two fixtures 10 are connected to junction box 70, one to each annular flange 79, the hollow housing may serve as a junction at which wires can be spliced. Cover 73 provides access to the splice connections within the junction box without necessitating the removal of the fixtures from the mounting assembly.

For the mounting arrangement illustrated in FIG. 9, end member 53 is cast such that collar 65 is closed and properly sealed. This may be achieved by a separate casting from the casting provided with open collars, or the end of collar 65 may be provided with a knock-out type of plate which can be removed with an appropriate hammer and tool if it is desired to use end member 53 for mounting or further connection purposes. In addition, if one of the annular flanges 79 of junction box 70 is not employed, a knock-out plate 85 may be provided within the annular flange, as best illustrated in FIG. 10. If it is subsequently desired to employ that flange for connection to a lighting fixture, plate 85 can be knocked out by an appropriate hammer and tool arrangement.

Figure 23:
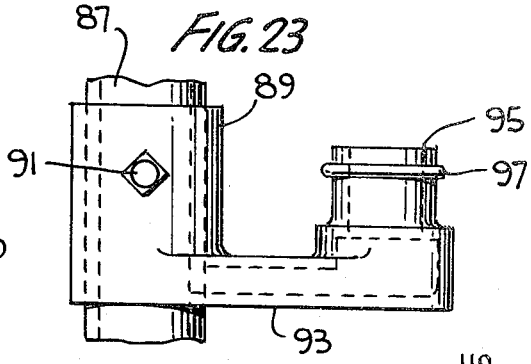
FIG. 23 is a side view in elevation of a further mounting bracket useful with the lighting fixture of the present invention.

A further form of mounting arrangement for the fixture of FIG. 1 is illustrated in FIG. 23. Specifically, the mounting arrangement illustrated in FIG. 23 is adapted to be secured about a cylindrical support 87. For this purpose, the mounting arrangement includes a hollow cylindrical portion 89 which is disposed concentrically and slidably about support 87. A plurality of threaded bolts 91 extend radially through threaded holes in cylindrical member 89 to selectively engage support 87 and thereby lock cylindrical member 89 in both its axial and rotative position relative to support 87. A base member 93 extends radially from the cylindrical portion 89 and supports a further annular flange 95 which is similar in all respects to the annular flange 79 associated with junction box 70 in FIGS. 9 and 10. An O-ring 97 provides the same purpose as O-ring 81 so that the annular flange 95 is adapted to be received in a collar 65 in an end plate of a lighting fixture 10. The interior of the base portion 93 is hollow so as to provide communication between the interior of cylindrical member 89 and the annular flange 95. In this manner, wiring can be extended through a suitable opening in support 87, through the base member 93 and annular flange 95 into the supported lighting fixture.

Figure 11:
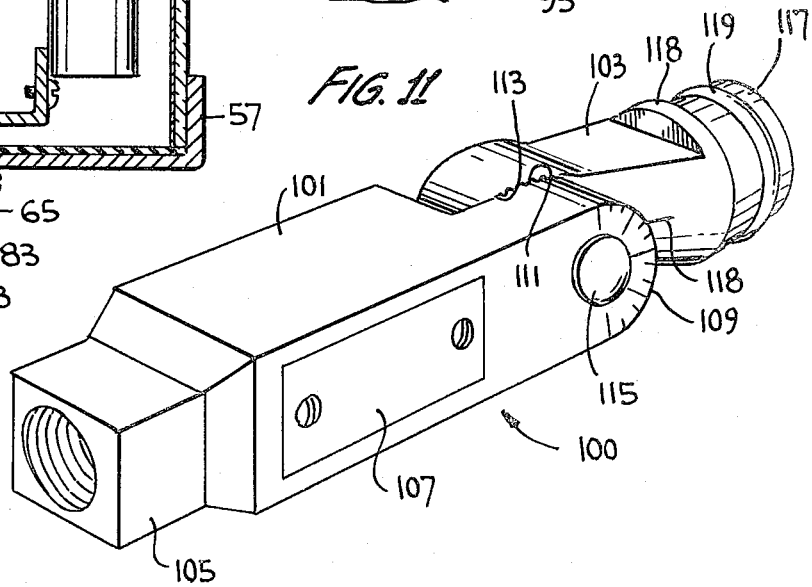
FIG. 11 is a view in perspective of a swivel-mount junction box which can be used to mount the lighting fixture of FIG. 1.

A swivel-type mounting or junction box 100 is illustrated in FIG. 11 and is useful for mounting lighting fixture 10 with another degree of positional adjustability. Specifically, the swivel junction box 100 includes a junction box portion 101 and a swivel connecting portion 103. The junction box portion is a hollow junction box having an internally-threaded cubic collar member 105 formed at one end. The collar member 105 is adapted to receive a tubular support member such as member 77 of FIG. 9 which is also adapted to serve as a conduit for wiring. A removable cover plate 107 provides access to the hollow interior of the junction box portion 101 so that the wiring within the junction box, particularly any splices made therein, can be easily accessed. The end of the junction box portion 101 which is remote from the collar 105 terminates in an arcuate projection 109. One surface of projection 109, which resides parallel to the longitudinal dimension of junction box portion 101, is provided with a plurality of teeth members 111 arranged at equal angular positions about an annular path. Member 103 has a similar surface with an annular path of teeth members 113 spaced in the same manner as teeth 111. The teeth members 111 and teeth members 113 are engaged in a ratcheting engagement which permits relative rotation of the two members 101 and 103 about a common axis. Discrete rotational positions of the two members are achieved by properly positioning the teeth 111 and 113. An adjustment screw 115 permits the two members 103 and 101 to be tightened to one another when the rotational position of these members is properly selected. The other end of member 103 terminates in an annular flange 117 having a suitable O-ring 119. Flange 117 serves the same purpose as flange 79 in FIG. 10 whereby the lighting fixture can be secured to that flange about an axis extending longitudinally of the lamp. The adjustment provided by means of teeth 111, 113 permit the members 101, 103 to be positionally adjusted about an axis which is perpendicular to the lamp access. Therefore, the mounting arrangement 100 of FIG. 11 provides for two degrees of positional adjustability.

As also seen from FIG. 11, the surface of projection 109 remote from teeth 111 may be provided with calibrated angle markings which, depending upon the alignment of a similar marking on member 103, permit the members 101, 103 to be adjusted in any selected angular orientation.

Figure 12:
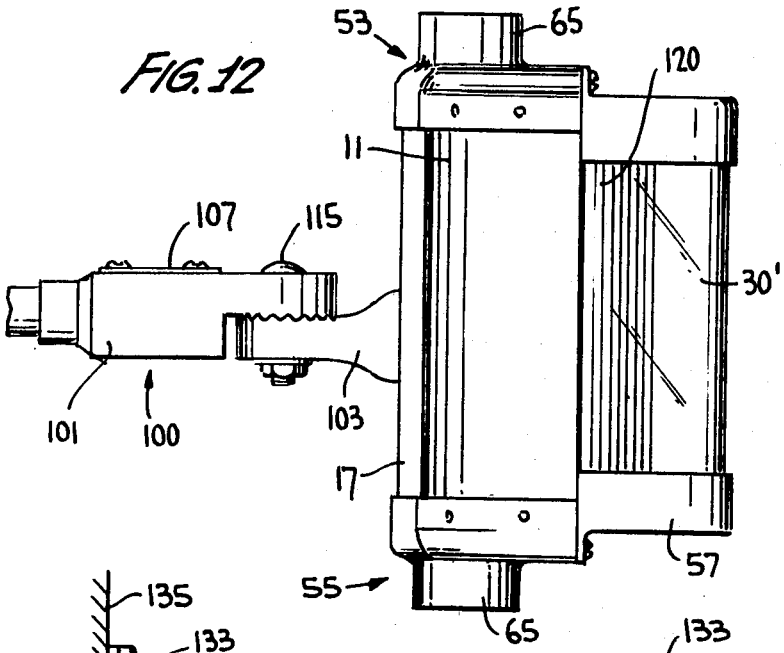
FIG. 12 is a side view in elevation of another lighting fixture embodiment of the present invention mounted by means of the swivel junction box of FIG. 11.

The swivel mounting arrangement 100 of FIG. 11 may also be employed as the sole means for adjusting the position of a lighting fixture. Such an arrangement is illustrated in FIG. 12 to which specific reference is now made. The junction box portion 101 is the same as described above in relation to FIG. 11 and like reference numerals are employed in both figures. The mounting portion 103, however, is modified so as to remove the annular flange 117. Instead, the distal end of member 103 is adapted, by any convenient means, to be secured to the frame member 11 of the lighting fixture at a location midway between the end members. Under such circumstances, both end members have their collars 65 sealed. In both of the embodiments illustrated in FIGS. 11 and 12, members 101 and 103 are hollow and permit wiring to be conducted between the two members to the lighting fixture. In this regard, the wiring passes about the outside of adjustment screw 115.

Figure 3:
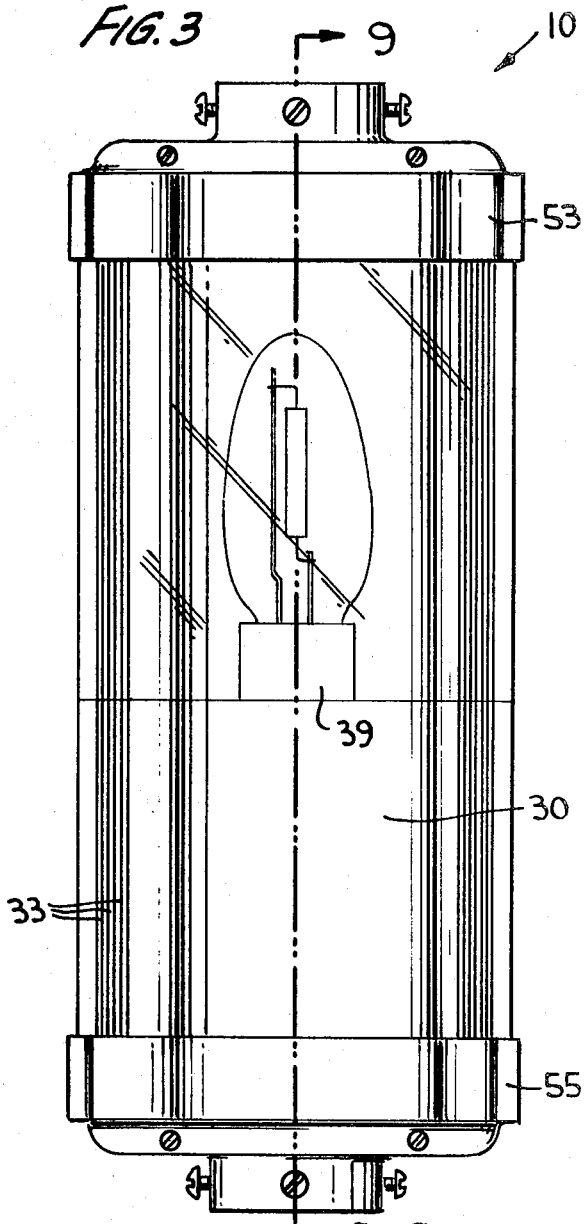
FIG. 3 is a front view in plan of the lighting fixture of FIGS. 1 and 2.
Figure 4:
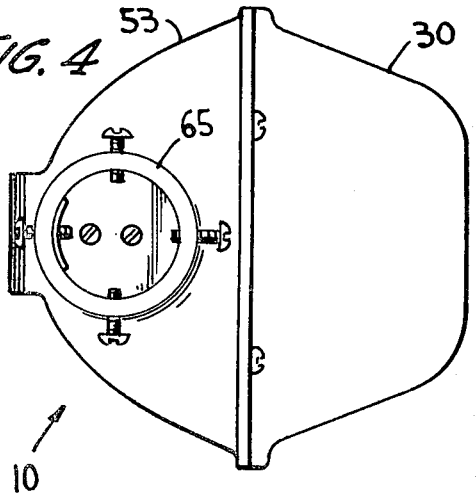
FIG. 4 is a top view in plan of the lighting fixture of FIG. 1.
Figure 5:
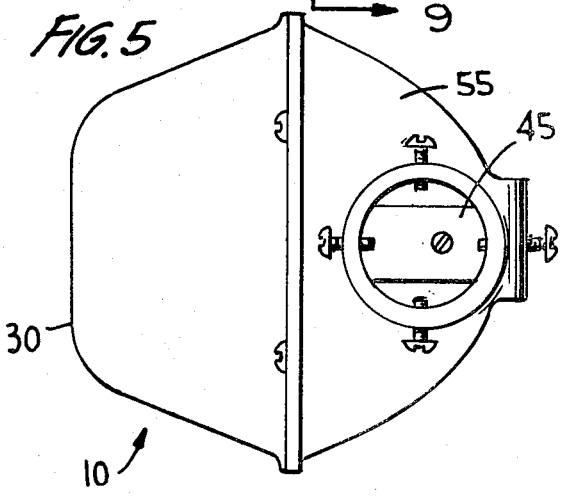
FIG. 5 is a bottom view in plan of the lighting fixture of FIG. 1.
Figure 13:
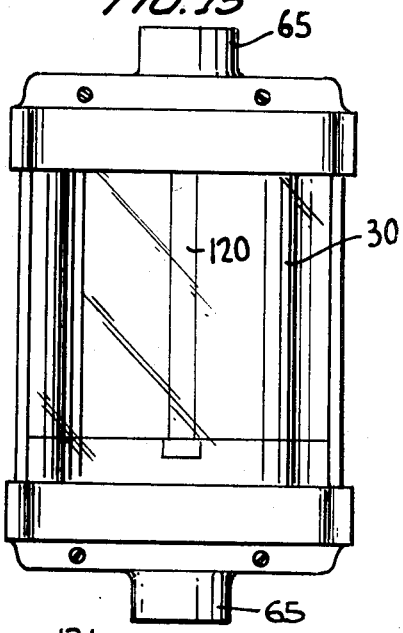
FIG. 13 is a front view in elevation of the lighting fixture of FIG. 12.

It should be noted that the lighting fixture, with improved angle of illumination, of the present invention does not require the particular lamp 40 illustrated in FIGS. 1 and 3. More particularly, any elongated or linear light source is considered to be appropriate within the scope of the present invention. For example, in FIGS. 12 and 13, an elongated fluorescent lamp 120 having a low ambient temperature ballast is employed. Lamp 120 is positioned parallel to the reflector frame 11 at a location perpendicular to the axis of symmetry of the parabola and with a portion of the lamp forward of the ends of the parabolic reflector so as to permit illumination of at least 180° relative to the lamp axis. This projection of lamp 120 forward of the ends of the parabolic reflector is best illustrated in FIG. 12. In this embodiment of the lamp, the lamp cover 30' is light-transmissive throughout its entire length since the fluorescent lamp source 120 extends substantially the entire length of the cover 30'.

Figure 14:
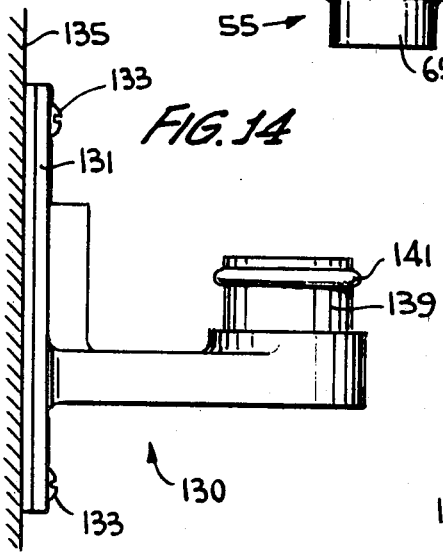
FIG. 14 is a side view in elevation of a wall mounting bracket useful with the lighting fixtures of FIGS. 1 and 13.
Figure 15:
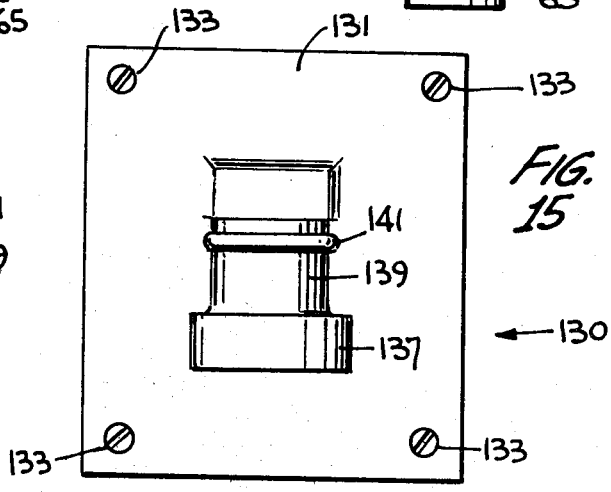
FIG. 15 is a front view in elevation of the mounting bracket of FIG. 14.
Figure 16:
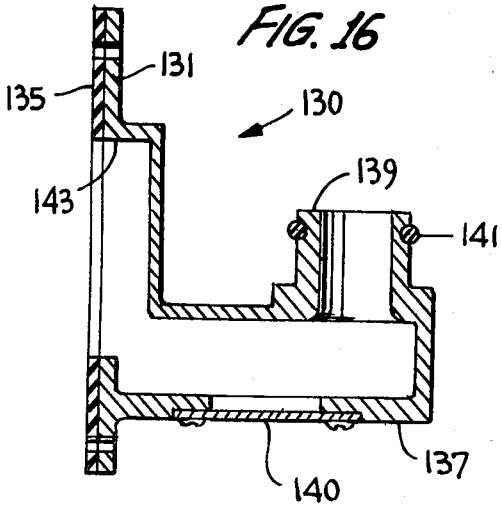
FIG. 16 is a side view in vertical cross-section of the mounting bracket of FIG. 14.

A further form of mounting arrangement for the lamp fixture of the present invention is illustrated in FIGS. 14, 15 and 16 to which specific reference is now made. Specifically, the mounting arrangement 130 includes a mounting plate 131 adapted to be secured by means of screws 133 or other suitable means to a wall 135 or other support surface. Mounting plate 131 is generally flat and has a base member 137 projecting forwardly therefrom from which an annular collar 139 projects upwardly. Annular collar 139, and its associated O-ring 141, are similar in configuration and function to the annular collar 79 and O-ring 81 of FIG. 10. Base member 137 is likewise hollow and communicates with an opening 143 defined in mounting plate 131 so that wiring can be extended through support wall 135, into the base member 137 and through the annular flange 139, and a splice box entry is covered by a plate 140, as shown in FIG. 16. A lighting fixture can be supported on flange 139 by inserting the flange in the annular collar 65 of a lighting fixture in a manner illustrated in FIG. 9.

Figure 18:
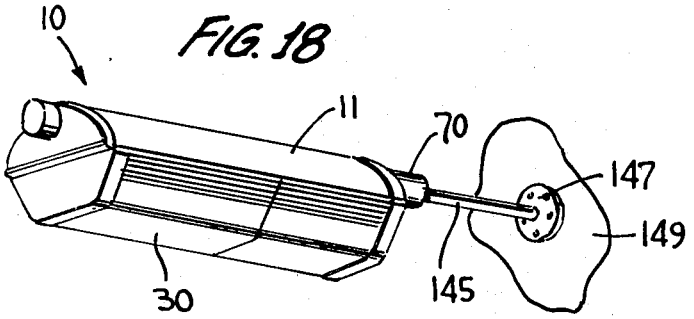
FIG. 18 is a view in perspective showing the lighting fixture of FIG. 1 in a particular mounting arrangement.

Referring specifically to FIG. 18, a simple mounting arrangement for a lighting fixture 10 of the present invention is illustrated. Specifically, the lighting fixture is oriented with its lengthwise dimension extending horizontally and is connected to a junction box 70. The junction box 70, in turn, is secured to a support tube 145 which, in turn, projects from a support plate mounted by means of screws or the like to a support wall 149. The support rod or tube 145 extends horizontally and conducts wiring from behind wall 149 into the fixture 10. The angular position of the fixture 10 relative to the junction box 70 determines the angular position of the fixture relative to the illuminated area.

Figure 19:
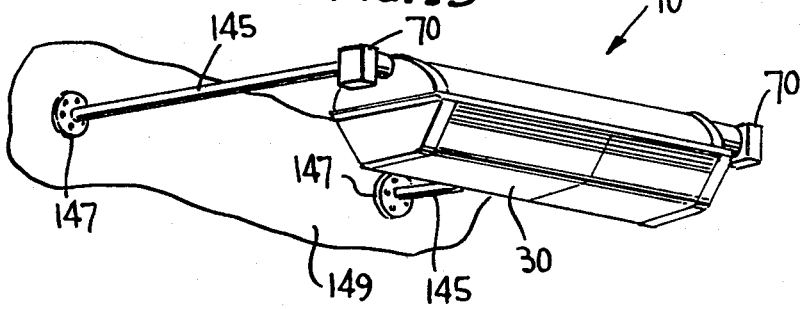
FIG. 19 is a view in perspective showing the lighting fixture of FIG. 2 in a second mounting arrangement.

A similar arrangement, utilizing two junction boxes 70 disposed at opposite ends of the lighting fixture 10, is illustrated in FIG. 19. Two support rods 145 projecting from support wall 149 are employed to provide greater structural support for the lighting fixture. Instead of the axis of rotational adjustment for lighting fixture 10 being generally parallel to the support rod 145 as in FIG. 18, the axis about which the fixture rotates in the FIG. 19 embodiment is perpendicular to the rods 145.

Figure 20:
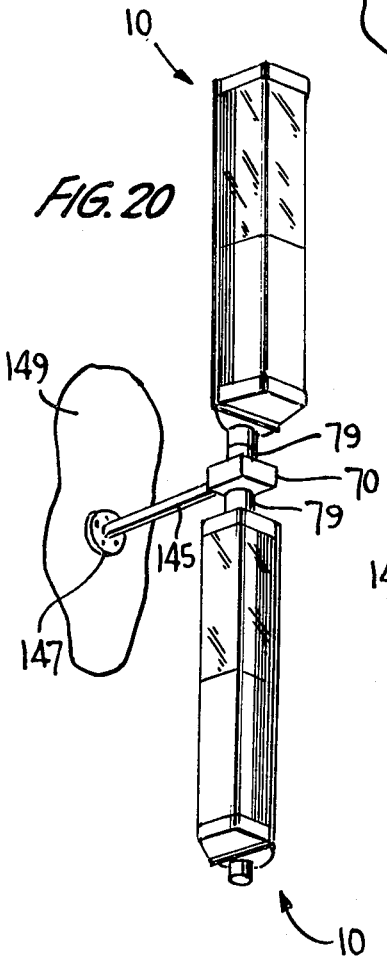
FIG. 20 is a view in perspective showing a mounting arrangement for two lighting fixtures of the present invention mounted in tandem.

Referring specifically to FIG. 20, two lighting fixtures 10 are positioned in general longitudinal alignment by connecting them to opposite annular flanges 79 of a common junction box 70. Junction box 70 is secured to support rod/conduit 145 which, in turn, is secured to a support wall 149 by means of a support plate 147. The two fixtures 10 of FIG. 20 may be rotated to the same or different angular positions with respect to junction box 70 to achieve the desired illumination coverage. Although the embodiment of FIG. 12 is illustrated with the elongated dimensions of the lighting fixtures extending vertically, it should be understood that the fixtures may be disposed horizontally or at oblique angles relative to the ground. Additionally, it is noted that the lighting fixtures can be arranged to provide various effective lengths as determined by lighting requirements.

Figure 21:
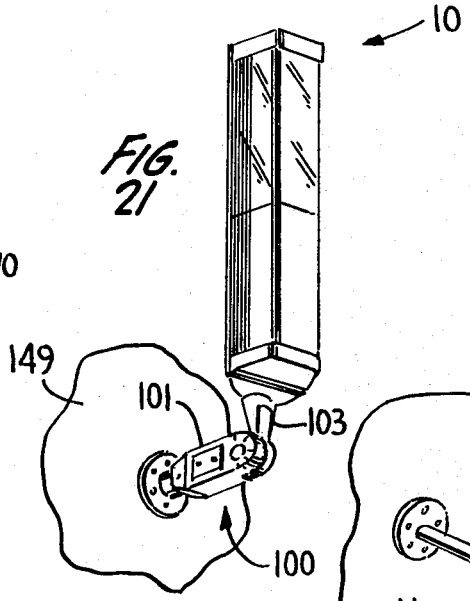
FIG. 21 is a view in perspective showing a mounting arrangement for the lighting fixture of FIG. 1 with the swivel junction box of FIG. 11.

Referring to FIG. 21, the swivel junction arrangement 100 is employed to support a lighting fixture 10 in a position which is adjustable in two dimensions. Specifically, as illustrated in FIG. 21, the axis of rotation of the parts 101 and 103 of the swivel junction 100 extends horizontally so that the lighting fixture 10 can be rotated up or down about this axis. In addition, the lighting fixture 10 may be rotated relative to annular flange 117 (see FIG. 11) so as to permit rotation of the lighting fixture about an axis perpendicular to the rotational axis for members 101, 103. These two degrees of rotation permit all the flexibility required to direct the 180° beam in any manner.

Figure 22:
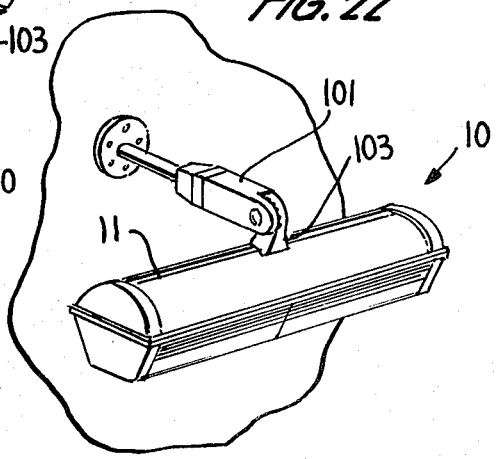
FIG. 22 is a view in perspective of the lighting fixture of FIG. 1 mounted in a further mounting arrangement.

A further mounting arrangement for lighting fixture 10 is illustrated in FIG. 22 wherein the swivel junction 100, including members 101 and 103, is secured to the frame member 11 of the lighting fixture intermediate the two ends of the lighting fixture. By adjusting the angular position of members 101 and 103, the position of lighting fixture 10 may be adjusted to adjust the field of illumination.

In all of the embodiments illustrated in FIGS. 18–22, it should be noted that the support rod associated with the junction box and/or swivel junction box is hollow and is employed to both support the mounting structure and conduct wiring through from a support wall to the lighting fixture.

The particular mounting arrangements illustrated in FIGS. 18–22 are by no means limiting on the various mounting arrangements that can be achieved with the apparatus described herein.

Inasmuch as the present invention is subject to many variations, modifications and changes in detail, it is intended that all subject matter discussed above or shown in the accompanying drawings be interpreted as illustrative and not in a limiting sense.

What is claimed is:

1. A lighting fixture for supporting an elongated light source which emits light radially from a longitudinal axis in an angular pattern which exceeds 180°, said fixture comprising:

an elongated reflector having a generally parabolic transverse cross-section with an axis of symmetry, said reflector having a pair of opposite edges which define an imaginary plane intersecting said axis of symmetry; and lamp socket means for supporting said elongated light source in generally perpendicular relationship with said axis of symmetry, spaced from said reflector, and with said longitudinal axis disposed in said imaginary plane or on a side of said imaginary plane which is remote from said reflector.

2. The lighting fixture according to claim 1 wherein said reflector has a parabolic reflecting surface facing said imaginary plane, which reflecting surface is made of anodized aluminum.

3. The lighting fixture according to claim 1 wherein said light source is a low ambient temperature fluorescent lamp.

4. The lighting fixture according to claim 1 wherein said light source is a high intensity discharge lamp.

5. The lighting fixture according to claim 1 wherein said reflector comprises:

a frame member having first and second reflective segments forming respective parts of said reflecting surface, said segments being spaced from one another to define a gap therebetween, said gap extending along the elongation dimension of said reflector; and an elongated connecting strip secured in contact with both of said reflective segments to fill in said gap, said connecting strips having a reflective surface which continues said substantially parabolic cross-section of said reflector;

wherein said strip and said frame member define a wiring conduit raceway therebetween which extends longitudinally behind said reflecting surface.

6. The lighting fixture according to claim 5 wherein said raceway and said connecting strip are symmetrically disposed with respect to a further plane including all of the axes of symmetry of transverse cross-section of said reflector.

7. The lighting fixture according to claim 5 wherein said lamp socket comprises:

a generally flat plate member;

a lamp socket for said light source secured to said plate member;

a lamp ballast secured to said plate member and electrically connected to said lamp socket; and means securing said plate member to said connecting strip with a single screw.

8. The lighting fixture according to claim 5, further comprising first and second members secured at respective ends of said frame member, at least said first member having a hollow cylindrical collar extending outwardly therefrom along a further axis parallel to the length dimension of said reflector and positioned to permit electrical leads to be extended through the collar so as to connect to said lamp socket means and to extend through said raceway.

9. The lighting fixture according to claim 8 further comprising mounting means for supporting said lighting fixture, said mounting means comprising:

a junction box including an annular flange adapted to be rotatably received about said further axis in said cylindrical collar of said first end member; and means for selectively securing said collar and flange in any desired mutual rotational position about said further axis within a 360° range;

wherein said electrical leads can extend from said junction box, through said flange and collar, into said frame member.

10. The lighting fixture according to claim 9 wherein said mounting means further comprises:

a hollow rigid conduit having first and second ends for conducting said electrical leads;

means for securing said first end of said conduit to a support structure; and means for securing said second end of said conduit to said junction box to permit passage of said electrical leads between said conduit and said junction box.

11. The lighting fixture according to claim 8 further comprising mounting means for supporting said lighting fixture, said mounting means comprising:

a first hollow member having an annular flange adapted to be rotatably received in said cylindrical collar of said first end member about said further axis;

means for selectively securing said collar and said flange in any desired mutual rotational position about said further axis within a 360° range;

a second hollow member;

means for securing said second member to a support structure; and means for securing said first member and said second member together in multiple selectable rotational positions about a support axis extending generally perpendicular to said further axis;

whereby said electrical leads can be extended through said first and second collar members to said frame member.

12. The combination according to claim 8 further comprising:

a further lighting fixture substantially identical to the first-described lighting fixture;

mounting means for supporting said first and second further lighting fixtures, said mounting means comprising:

a junction box including first and second annular flanges extending in different directions, said first flange being adapted to be rotatably received about said further axis in said cylindrical collar of said first lighting fixture, said second flange being adapted to be rotatably received about said further axis in said cylindrical collar of said second lighting fixture;

means for selectively securing said first flange and said collar of said first lighting fixture in any desired mutual rotational position about said further axis of said first member within a 360° range;

means for selectively securing said second flange and said collar of said second lighting fixture in any desired mutual rotational position about said further axis of said second member in a 360° range;

whereby said electrical leads can extend from said junction box and into the frame members of both of said lighting fixtures through respective flanges.

13. The lighting fixture according to claim 5 further comprising:

first and second end members secured at respective ends of said frame member, each end member having a hollow cylindrical collar extending outwardly therefrom along a further axis parallel to the length dimension of said reflector and positioned to permit electrical leads to be extended through the collars so as to connect to said lamp socket means and to pass through said raceway between said collars.

14. The lighting fixture according to claim 13 further comprising mounting means for supporting said lighting fixture, said mounting means comprising:

a first junction box including an annular flange adapted to be rotatably received about said further axis in said cylindrical collar of said first end member;

a second junction box including a second annular flange adapted to be received about said further axis in said cylindrical collar of said second end member;

means for selectively securing said collar of said first end member and said first annular flange in any desired mutual rotational position about said further axis within a 360° range;

means for selectively securing said collar of said second end member and said second flange in any desired mutual rotational position about said further axis within a 360° range;

whereby said electrical leads can extend from said junction boxes, through said flanges and collars and into said frame member.

15. The lighting fixture according to claim 14 wherein said mounting means further comprises:

first and second hollow rigid conduits, each having first and second ends, for conducting said electrical leads;

means for securing said first end of said first conduit and said first end of said second conduit to a support structure;

means for securing said second end of said first conduit to said first junction box to permit passage of said electrical leads between said conduit and said junction box; and means for securing said second end of said second conduit to said second junction box to permit passage of said electrical leads between said second conduit and said second junction box.

16. The lighting fixture according to claim 1 wherein said lamp socket means comprises:

a generally flat plate member;

a lamp socket for said light source secured to said plate member;

a lamp ballast secured to said plate member and electrically connected to said lamp socket; and means securing said plate member to said reflector with a single screw.

17. The lighting fixture according to claim 1 further comprising:

first and second end members secured at respective ends of said reflector, at least said first end member having a hollow cylindrical collar extending outwardly therefrom along a further axis parallel to the length dimension of said reflector and positioned to permit electrical leads to be extended through the collar so as to connect to said lamp socket means.

18. The lighting fixture according to claim 17 further comprising mounting means for supporting said lighting fixture, said mounting means comprising:

a junction box including an annular flange adapted to be rotatably received about said further axis in said cylindrical collar of said first end member; and means for selectively securing said collar and flange in any desired mutual rotational position about said further axis within a 360° range;

whereby said electrical leads can extend from said junction box through said flange and collar to said lamp socket means.

19. The lighting fixture according to claims 5, 9, 11, or 14 further comprising a light-transmitting cover secured to said frame to perfect said reflector and said light source, said cover having a plurality of light refractive ridges extending parallel to the length dimension of said reflector.

20. The lighting fixture according to claim 5 further comprising mounting means for supporting said lighting fixture, said mounting means comprising:

a first hollow member adapted to be connected to said frame member;

a second hollow member;

means for securing said second hollow member to a support structure; and means for securing said first member and said second member together in multiple selectable rotational positions about a support axis extending generally parallel to the length dimension of said reflector.

* * * * *